US005882445A

United States Patent [19]

Roth

[11] Patent Number: 5,882,445

[45] Date of Patent: Mar. 16, 1999

[54] METHOD OF MAKING SEMI-FINISHED METAL PRODUCTS

[75] Inventor: Stefan Roth, Dresden, Germany

[73] Assignee: Institut fuer Festkoerper-und Werkstofforschung Dresden e.V., Dresden, Germany

[21] Appl. No.: 750,692

[22] PCT Filed: Apr. 13, 1996

[86] PCT No.: PCT/EP96/01569

§ 371 Date: Dec. 18, 1996

§ 102(e) Date: Dec. 18, 1996

[87] PCT Pub. No.: WO96/34118

PCT Pub. Date: Oct. 31, 1996

[30] Foreign Application Priority Data

Apr. 22, 1995 [DE] Germany ..... 195 14 889.4

[51] Int. Cl.[6] ..... C21D 3/00; C21D 3/02; C21D 3/04

[52] U.S. Cl. ..... 148/541; 148/596; 148/615; 148/625; 148/629; 148/634; 148/712; 148/674

[58] Field of Search ..... 148/541, 596, 148/615, 625, 628, 634, 712, 674

[56] References Cited

FOREIGN PATENT DOCUMENTS 450841 7/1936 United Kingdom .

*Primary Examiner*—Sikyin Ip
*Attorney, Agent, or Firm*—McAulay Nissen Goldberg Kiel & Hand, LLP

[57] ABSTRACT

A method for producing metallic semifinished products such as strip or wire from metallic work materials which have a high melting point and are difficult to shape, comprising the steps of a) first, alloying at least one element for lowering the melting point with a material that has a high melting point and is difficult to shape; b) then, producing the semifinished product from the alloy with the reduced melting point in the form of strip or wire directly from the melt by quick solidification; and c) finally extracting the elements alloyed with the material in method step a) from the semifinished product by heat treatment in a reactive atmosphere.

10 Claims, No Drawings

METHOD OF MAKING SEMI-FINISHED METAL PRODUCTS

BACKGROUND OF THE INVENTION a) Field of the Invention

The invention relates to the field of metallurgic materials processing and is directed to a method for the manufacture of semifinished metal products such as strip or wire from metal materials which have a high melting point and are difficult to shape. The method is applicable, for instance, for the production of soft-magnetic strip from FeSi alloys, for the production of strip from FeCo base alloys, and for the production of cobalt strip or cobalt wire.

b) Description of the Related Art

Some metals and many alloys with desirable technical properties can only be brought to the desired semifinished form, if at all, by means of costly shaping. For example, it is difficult to produce wire from highly pure cobalt by means of shaping. Problems also arise in the shaping of FeSi alloys with more than 4% silicon to form semifinished product used as soft-magnetic materials. In general, those alloys which are difficult to shape are formed chiefly by transition metals, especially alloys having ordered lattice structures.

It is also known to produce metal semifinished products in the form of strip or wire directly from the melt by one of the quick solidification processes. However, this method is difficult to use when the material to be processed has a high melting point (roughly greater than 1400° C.), since the equipment for quick solidification in this case must be produced from work materials which are very expensive and difficult to work with and/or which are prone to rapid wear. This results in high manufacturing costs.

OBJECT AND SUMMARY OF THE INVENTION

The primary object of the invention is to provide a method by which metal materials which have a high melting point and are difficult to shape can be processed to form semifinished products such as strip or wire with manageable techniques and at low cost.

In accordance with the invention, the improved method comprises the steps of a) first, alloying one or more elements for lowering the melting point with a material that has a high melting point and is difficult to shape, b) then producing the semifinished product from the alloy with the reduced melting point in the form of strip or wire directly from the melt by quick solidification, and c) finally extracting the elements alloyed with the material in method step a) from the semifinished product by heat treatment in a reactive atmosphere.

DESCRIPTION OF THE PREFERRED EMBODIMENTS

According to a preferred embodiment of the invention, at least one element of the group composed of boron, carbon and phosphorous is alloyed with the material in method step a).

The element or elements which reduce the melting point are alloyed in an amount such that the melting point of the alloy is reduced to a temperature of less than 1600° C., preferably less than 1400° C.

Further, the invention provides that hydrogen is used as a reactive atmosphere in method step c) for the heat treatment of the semifinished product. According to an advantageous construction, the heat treatment of the semifinished product is effected first in moist hydrogen at a temperature between 850° and 1000° C. and then in dry hydrogen at a temperature between 1000° and 1250° C.

During the heat treatment of the semifinished product, the hydrogen atmosphere can advisably be renewed continuously or intermittently by means of rinsing.

In order to produce the semifinished product from FeSi alloys with a silicon content of more than 4%, boron is first added to the alloy according to the invention in an amount at which the melting point of the alloy is reduced to less than 1400° C. Semifinished product is then produced from this alloy by means of the method of quick solidification. Finally, this semifinished product is heat-treated at a temperature ranging from 870° to 950° C. for a period of 1.5 to 4 hours in moist hydrogen and, in conclusion, at a temperature ranging from 950° to 1120° C. for a period of at least 1.5 hours in dry hydrogen. The gaseous boron compounds absorbed by the hydrogen atmosphere during the heat treatment are advisably removed from the heat treatment space by rinsing with fresh hydrogen.

The same steps can be taken when producing semifinished product from FeCo base alloys with a cobalt content of 5 to 70% or when producing semifinished product from cobalt.

The method according to the invention provides the preconditions for an automated, economical production of semifinished product such as strip or wire from metallic work materials which have a high melting point and are difficult to shape. Another advantage consists in that the method can be carried out with conventional metallurgical installations and is easy to manage.

In the following, the invention is explained in more detail with reference to embodiment examples.

EXAMPLE 1

Pure cobalt is alloyed with 4.4 percent by mass boron. The melting point of this cobalt-boron alloy is 1105° C., that is, appreciably lower than the melting point of pure cobalt at 1495° C. Strip with a thickness of 0.022 mm and a width of 10 mm is produced from this alloy by means of quick solidification. This strip is first heat-treated at 900° C. for 2 hours under a moist hydrogen flow. The boron content is accordingly reduced to 0.27 percent by mass. After further heat treatment under a dry hydrogen flow at 1100° C. for two hours, the boron content is reduced to 0.01 percent by mass. The strip obtained in this way has ductile characteristics.

EXAMPLE 2

An additional 2.1 percent by mass of boron is alloyed with a FeSi alloy with a Si content of 8.1 percent by mass and a melting point of 1380° C. which can be used as soft-magnetic material. The occurring 7.9 Si-2.0 B residual Fe alloy has a melting point of 1150° C. An amorphous strip with a thickness of 0.022 mm is then produced directly from a melt of this alloy by means of quick solidification. This strip is then heat-treated in an annealing furnace for 2 hours at a temperature of 900° C. in moist hydrogen and then for another 2 hours at a temperature of 1100° C. in dry hydrogen. During the heat treatment, the boron is liberated from the alloy and a gaseous compound enters with the hydrogen atmosphere. This compound is removed from the furnace room by constant rinsing with fresh hydrogen.

The Fe-8.1% Si strip which is obtained can be used as soft-magnetic material. Its coercive field strength $H_c$ is 40 A/m. The boron content of the strip is less than 0.01 percent by mass.

EXAMPLE 3

Boron (1.8 percent by mass) is added to a FeSi alloy with a Si content of 7.0 percent by mass. In this way, the melting point of the alloy is reduced from 1415° C. to 1160° C. Strip with a width of 10 mm and a thickness of 0.024 mm is produced from this alloy by means of quick solidification. After a first heat treatment at 900° C. for 2 hours under a moist hydrogen flow and a second heat treatment under a dry hydrogen flow at 1100° C. for two hours, the material has a boron content of less than 0.01 percent by mass. The strip produced in this way has a coercion field strength $H_c$ of 35 A/m. The magnetostriction is less than 0.1 ppm.

While the forgoing description and drawings represent the present invention, it will be obvious to those skilled in the art that various changes may be made therein without departing from the true spirit and scope of the present invention.

What is claimed is:

1. A method for producing metallic semifinished products from metallic work materials which have a high melting point and are difficult to shape, comprising the steps of:

a) first, alloying at least one element for lowering the melting point with a material that has a high melting point and is difficult to shape;

b) then, producing the semifinished product from the alloy with the reduced melting point in the form of strip or wire directly from a melt by quick solidification; and c) finally extracting the elements alloyed with the material in method step a) from the semifinished product by heat treatment in a reactive atmosphere.

2. The method according to claim 1, wherein at least one element selected from the group consisting of boron, carbon and phosphorous is alloyed with the material in method step a).

3. The method according to claim 1, wherein said at least one element for reducing the melting point is alloyed with the material in method step a) in an amount such that the melting point of the alloy is reduced to a temperature of less than 1600° C.

4. The method according to claim 1, wherein hydrogen is used as a reactive atmosphere in method step c) for the heat treatment of the semifinished product.

5. The method according to claim 1, wherein the heat treatment of the semifinished product is effected first in moist hydrogen at a temperature between 850° and 1000° C. and then in dry hydrogen at a temperature between 1000° and 1250° C. in method step c).

6. The method according to claim 5, wherein the hydrogen atmosphere is renewed continuously during the heat treatment of the semifinished product by of rinsing.

7. The method according to claim 1, wherein the method is applied for producing semifinished product from FeSi alloys with a silicon content of more than 4%, for producing semifinished product from FeCo base alloys with a cobalt content of 5 to 70% or for producing semifinished product from cobalt, wherein boron is first added to the starter material in an amount at which the melting point of the material is reduced to less than 1400° C., semifinished product is then produced from this alloy by means of the method of quick solidification and, finally, said semifinished product being heat-treated at a temperature ranging from 870° to 950° C. for a period of 1.5 to 4 hours in moist hydrogen and at a temperature ranging from 950° to 1120° C. for a period of at least 1.5 hours in dry hydrogen.

8. The method according to claim 7, wherein the gaseous boron compounds absorbed by the hydrogen atmosphere during the heat treatment are removed from the heat treatment space by rinsing with fresh hydrogen.

9. The method according to claim 3, wherein the melting point of the alloy is reduced to a temperature of less than 1400° C.

10. The method according to claim 6, wherein the hydrogen atmosphere is renewed intermittently during the heat treatment of the semifinished product by rinsing.

* * * * *